United States Patent [19]

Korr et al.

[11] 4,036,140

[45] July 19, 1977

[54] AMMUNITION

[75] Inventors: Abraham L. Korr, Philadelphia, Pa.; Evan Harris Walker, Aberdeen, Md.; Charles M. Dickey, Huntingdon Valley; Bransby W. Bushey, Philadelpia, both of Pa.

[73] Assignee: The United States of America as represented bythe Secretary of the Army, Washington, D.C.

[21] Appl. No.: 737,925

[22] Filed: Nov. 2, 1976

[51] Int. Cl.[2] ..... F42B 5/02

[52] U.S. Cl. ..... 102/38; 102/7.2; 102/DIG. 7; 102/61; 102/68

[58] Field of Search ..... 102/5, 34.4, 35.6, 37.6, 102/38, 40, 61, 67, 68, 69, DIG. 7, 7.2

[56] References Cited

U.S. PATENT DOCUMENTS

| | | | |
|---|---|---|---|
| 1,284,777 | 11/1918 | Rinehart | 102/61 |
| 3,954,060 | 5/1976 | Haag et al. | 102/DIG. 7 |
| 3,956,990 | 5/1976 | Rowe | 102/DIG. 7 |

*Primary Examiner*—Harold Tudor

*Attorney, Agent, or Firm*—Nathan Edelberg

[57] ABSTRACT

A hypervelocity ammunition round in which a fin stabilized artillery projectile contains a plurality of subcaliber gun tubes for launching subcaliber fin stabilized flechette projectiles from the artillery projectile at a predetermined point in its trajectory, as the artillery projectile performs as a moving gun platform to more effectively defeat a multiplicity of targets through the kinetic energy impact of the subcaliber projectiles. The round utilizes a traveling charge arrangement in launching both the artillery projectile and each of the subcaliber projectiles.

6 Claims, 10 Drawing Figures

AMMUNITION

The invention described herein may be manufactured, used and licensed by or for the Government for governmental purposes without the payment to us of any royalty thereon.

This invention relates to ammunition and more particularly, to an ammunition round having a fin stabilized artillery projectile that performs as a moving gun platform.

It is an object of the invention to provide a muti-stage hypervelocity ammunition round having each stage propelled independtly by sequentially initiated elements.

Another object of the invention is to provide such an ammunition round having a maximum of effectiveness capability.

A further object of the invention is to provide such an ammunition round having a maximum of accuracy capability.

These and other objects, features and advantages will become more apparent from the following description and accompanying drawings in which.

Figure 1:
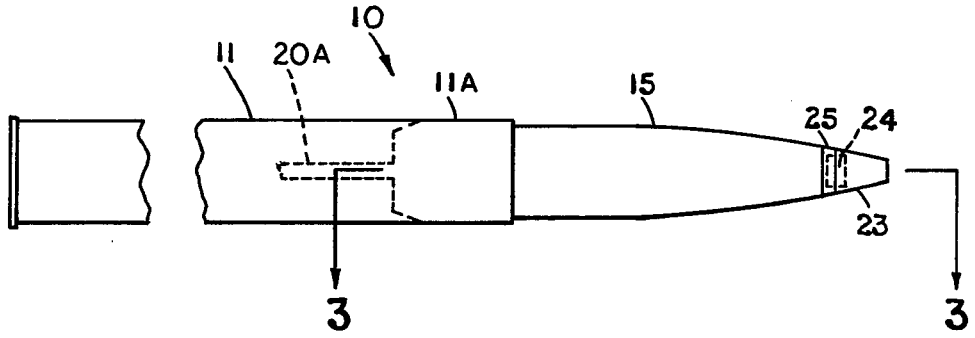
FIG. 1 is a longitudinal elevational view of a preferred ammunition round embodying the principles of the invention, with certain parts broken away and others shown in phantom.
Figure 2:
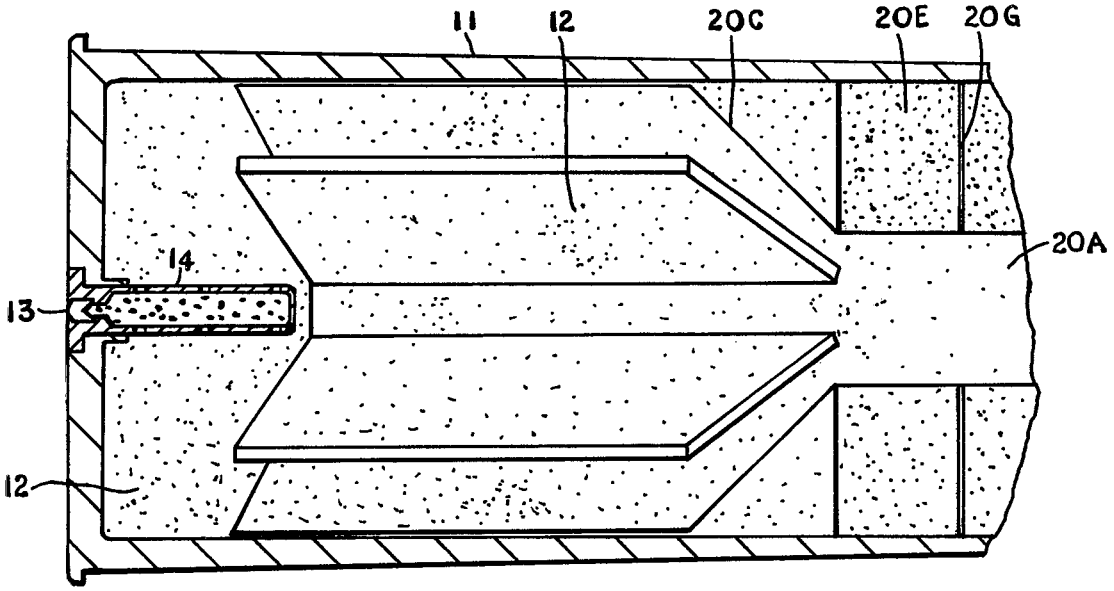
FIG. 2 is an enlarged sectional view of a rearward portion of the FIG. 1 arrangement.
Figure 3:
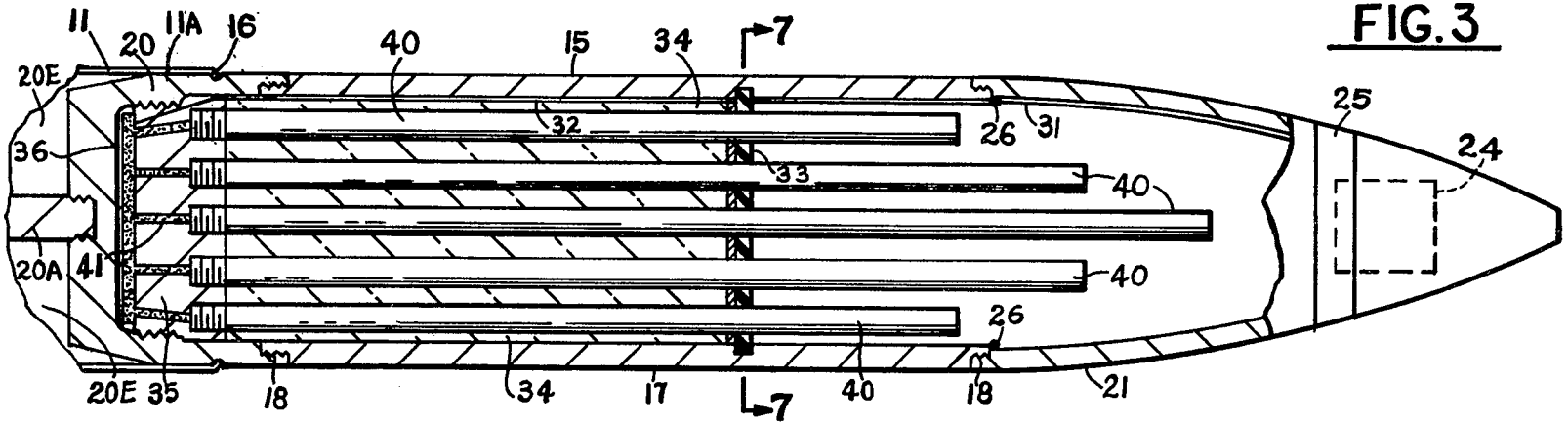
FIG. 3 is an enlarged sectional view taken substantially along line 3—3 of FIG. 1.
Figure 4:
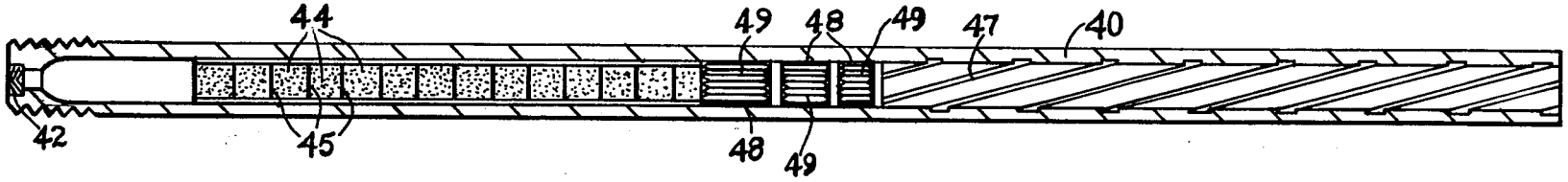
FIG. 4 is an enlarged sectional view of one of the subcaliber gun tubes shown in FIG. 3.

The hypervelocity artillery ammunition round, shown generally at 10, has a cartridge case 11 (FIGS. 1-3) containing a propellant charge 12 ignitable by an appropriate primer 13, centrally secured in the rearward base portion of the case 11, with a multi-apertured tube 14 extending longitudinally through a portion of the charge and by which the latter is in fluid communication with the primer for launching a fin stabilized main projectile 15 from the mouth 11A of the cartridge case in which it is crimpingly secured.

Figure 8:
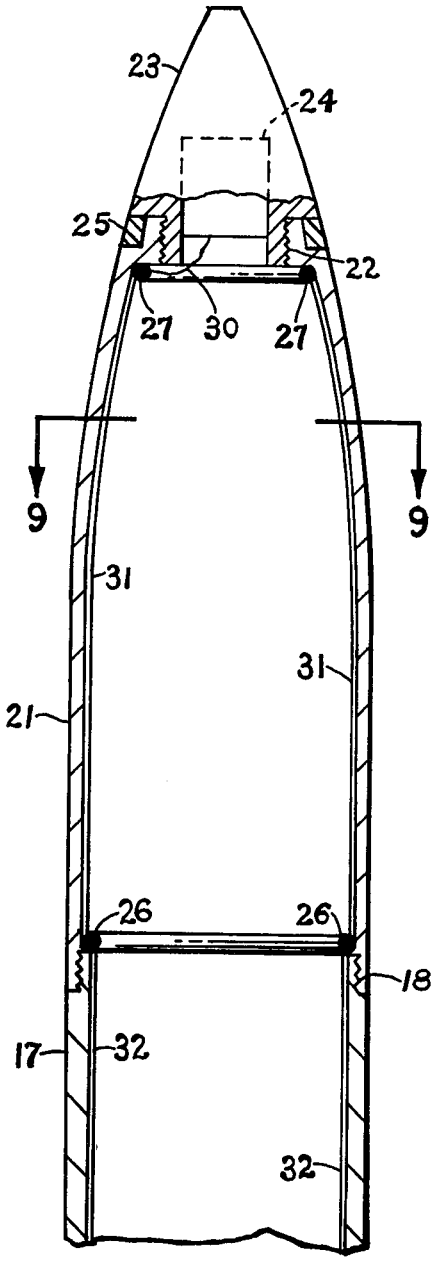
FIG. 8 is an enlarged partial sectional view similar to FIG. 3 with certain parts omitted.
Figure 9:
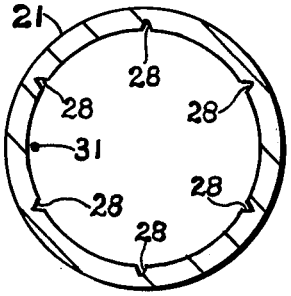
FIG. 9 is a sectional view taken along line 9—9 of FIG. 8.
Figure 10:
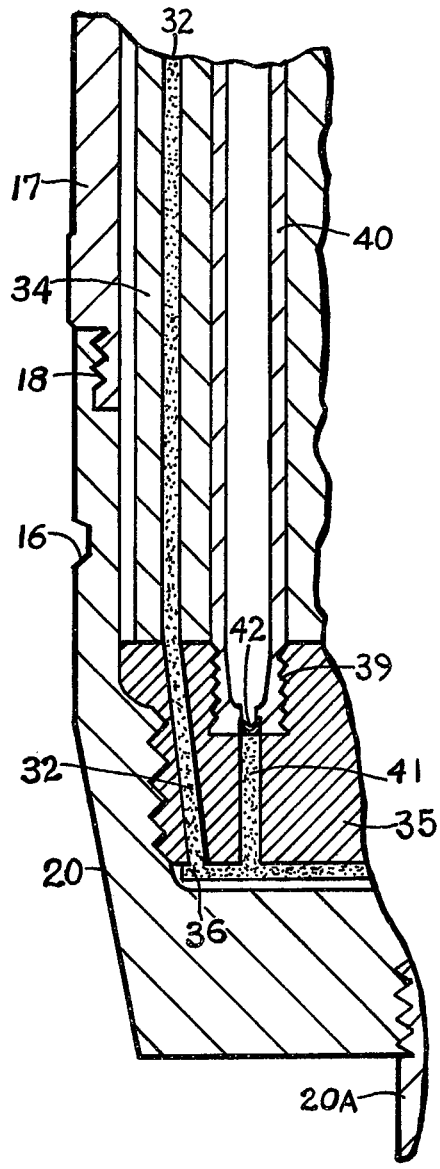
FIG. 10 is an enlarged sectional view of a rearward portion of the FIG. 3 projectile with certain parts omitted.

The projectile 15 preferably has an annular crimping groove 16 (FIG. 3) for securement of the cartridge case mouth upon the projectile 15. The main body portion of projectile 15 comprises a hollow cylindrical sidewall 17 (FIGS. 3, 8, 10) having externally threaded reduced annular sleeve portions 18, 18 upon which correspondng portions of the projectile base member 20 and forward ogive portion 21 are matingly secured. The projectile base member 20 has threadedly secured thereto a rearwardly extending central boom portion 20A terminating in a plurality (preferably 6) of radially extending canted fins 20C (FIG. 2) for operational flight stabilization subsequent to the finned projectile 15 being launched through a smooth bore or slow twist rifled gun barrel (not shown). Surrounding the projectile boom portion 20, and preferably extending alongs its longitudinal length, are a plurality of annular traveling charge elements 20E of end burning type and fast burning rate propellant such as Hivelite or the equivalent, successive elements of which are longitudinally spaced by an intermediate annular ignition delay element 20G of aluminum foil or the equivalent. The forwardly and inwardly tapering ogive portion 21 terminates with an inwardly offset internally threaded annulus 22 (FIG. 8) for securement of the forwardmost conically shaped nose member 23 that contains an appropriate timing or proximity fuze 24. A suitable ring adapter 25 strengthens the nose connection and provides a mating smooth or continuous forward external surface. Adjacent the ends of ogive portion 21, corresponding annular rings of primacord 26, 27 are adhesively secured in transverse positions upon the ogive internal surface that is with a plurality of circumferentially spaced serrations of preformed grooves 28 (FIG. 9) that extend longitudinally between and substantially normal to the longitudinally spaced primacord annular rings 26, 27. The smaller and forwardmost primacord ring 27 is connected to fuze member 24 by a pyrotechnic ignition line 30 and to the larger primacord ring 26 by primacord or pyrotechnic ignition line 31 which extends longitudinally along and is adhesively secured to the inner surface of ogive portion 21.

After projectile launch and a predetermined period of operational or trajectory flight the timing or proximity fuze, through energy transfer or pyrotechnic ignition line 30, will initiate the fuze ejection element or primacord ring 27 to circumferentially detonate the latter and rupture the adjacent sidewall of ogive portion 21 rearwardly adjacent ring adapter 25 to eject or discard the fuze nose 23 and associated parts. Simultaneous with the continued ignition or controlled burning of energy transfer or pyrotechnic line 31, the serrated or preweakened sidewall of ogive portion 21 will tend to break away in response to the forces of the passing or traversed pressure fluid, to assist the ogival ejection element or primacord ring 26 in ejecting or discarding the ogive portion 21 as the sidewall adjacent detonated ring 26 is circumferentially ruptured.

Extending rearwardly of and interconnecting with the ogival ejection element 26 is a similar pyrotechnic, primacord or engery transfer line 32 (FIGS. 3, 7, 8, 10) that extends longitudinally along the internal surface of cylindrical sidewall 17 (to which it is adhesively secured), through a small opening in transverse steel or metallic support plate 33, molded epoxy or equivalent plastic body 34, and through a passageway in a steel base support 35, where it connects with an explosive initiator or sheet 36 of Hivelite, Ammolite or equivalent fast burning rate propellant that is adhesively secured to the rearward face of base support 35.

Base support 35 is threadedly mounted in projectile base member 20 and has a plurality of laterally spaced forwardly opening tapped recesses 39 (FIG. 10) in its forward surface for threaded securement of corresponding subcaliber launch tubes 40 (FIGS. 3, 4, 7, 10) that extend longitudinally and parallel to each other through the molded body 34 and the forwardly adjacent multi-apertured support plate 33. The base of each recess 39 in the base support 35 has a small rearwardly extending longitudinal passage containing a corresponding one of the short parallel pyrotechnic, primacord or energy transfer lines 41 that operatively interconnect the explosive sheet 36 with a respective primer 42 centrally positioned in the rearward end of each launch tube 40.

Figure 5:
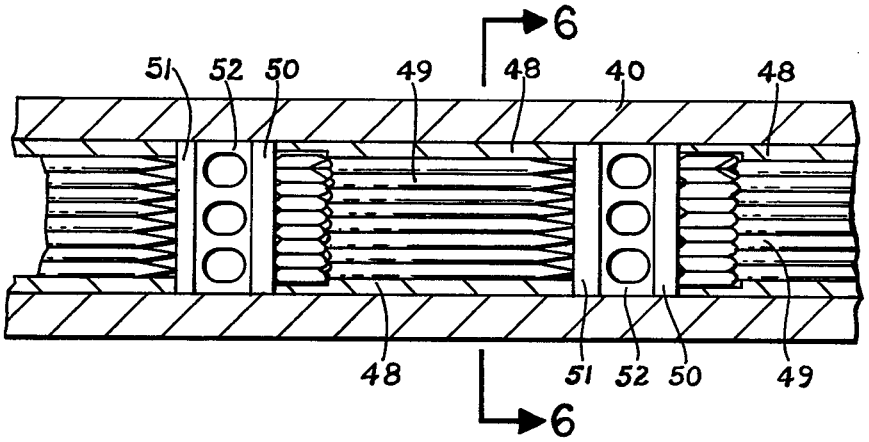
FIG. 5 is an enlarged partial sectional view of successive tandem mounted subcaliber flechette projectile assemblies positioned in the gun tube of FIG. 4
Figure 6:
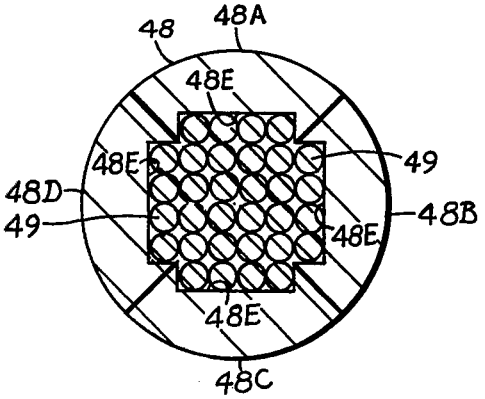
FIG. 6 is a sectional view taken along line 6—6 of FIG. 5.
Figure 7:
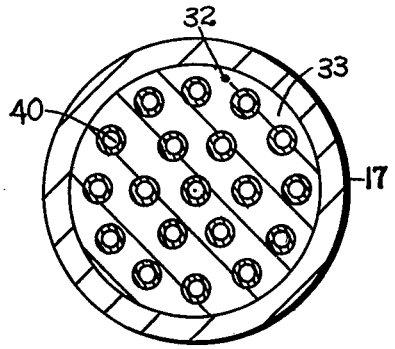
FIG. 7 is an enlarged sectional view taken along line 7—7 of FIG. 3

Each subcaliber launch tube 40 contains a plurality of tandemly mounted subcaliber traveling charge elements 44 (FIG. 4) of an end burning type and fast burning rate propellant, longitudinally adjacent pairs of charge elements 44 being separated by a charge saparator or ignition delay element 45 of a relatively slower burning rate material. Each rearmost one of the corresponding longitudinal series of sequentially initiated traveling propellant charges 44 is located proximate the corresponding primer 42 in a rearward portion of the respective launch tube 40. The forward portion of each launch tube 40 has appropriate internal rifling groove means 47 to impart spin to the plurality of tandemly mounted sub-modular assemblies each of which includes a cylindrical sabot 48 (FIGS. 4, 5, 6) containing a plurality or group of predeterminedly dimensioned flechette type projectiles 49. Each of the subcaliber sabots 48 comprises a plurality (preferably 4) of suitable longitudinally extending segmental cylindrical elements 48A, 48B, 48C, 48D and is operatively deformed and imparted with spin as each tandemly mounted group of sabots 48 travel through their corresponding subcaliber launch tube riflng grooves 47. Each sabot, within a launch tube group of longitudinally aligned sabots 48, preferably has a length greater than that of its forwardly adjacent sabot, so as to accommodate respectively and varying dimensioned groups of sub-projectiles or flechettes 49 positioned within each corresponding sabot. Each of successive sabots 48 in each subcaliber launch tube group of sabots is longitudinally spaced by a separator assembly comprising a pair of pusher discs 50, 51 and an intermediate compressive wad 52 of plastic material or the equivalent therebetween. Within each assembled segmental subcaliber sabot 48, in which each segment portion has an arcuate exterior surface and a rectangularly recessed internal surface 48E, a plurality of predeterminedly dimensioned flechettes are suitably positioned in a prelaunch condition.

As the primacord ring 26 detonates to eject or discard the ogive portion 21 as hereinbefore described to present a moving platform, the pyrotechnic line 32 continues to burn and thereby detonate the explosive sheet 36, whereupon the short primacord lines 41 will substantially simultaneously ignite each of subcaliber launch tube primers 42 and thus initiate the rearmost one of each series of traveling charges 44. In this manner an array of flechettes 49 is launched from the corresponding launched sabots 48 and subcaliber launch tubes 40 of the forward moving in-flight platform.

Various modifications, changes or alterations may be resorted to without departing from the scope of the invention as defined in the appended claims.

We claim:

1. An ammuniton round comprising, a main projectile body portion having a tubular sidewall rearwardly terminating in a base portion, a boom extending rearwardly from said base portion and terminating in a plurality of canted stabilizing fins, a cartridge case secured to said projectile body portion, said cartridge case containing a primer and housing said boom, a plurality of sequentially initiatable traveling charges surrounding said boom and intermediate said base portion and said primer, an ignition delay element intermediate longitudinally successive ones of said traveling charges, a forward ogive portion connected to said sidewall and having a forwardmost nose member containing fuze means, an ogival ejection element carried by a rearward portion of said ogive portion, ignition means interconnecting said ogival ejection element with said fuze means, a plurality of launch tubes secured in said projectile main body portion, each launch tube carrying a plurality of fin stabilized sub-projectiles and means including a primer and traveling charges for launching the corresponding fin stabilized sub-projectiles from the respective launch tube, an initiator secured in said base portion, and ignition means interconnecting said initiator with said ogival ejection element and each of said launch tube primers.

2. The structure in accordance with claim 1 wherein each launch tube contains a plurality of longitudinally aligned sabots, and the fin stabilized sub-projectiles of each launch tube are positioned in the corresponding sabots.

3. The structure according to claim 2 wherein each of said launch tubes has internally grooved rifling portion.

4. The structure of claim 3 wherein each of said sub-projectiles have canted stabilizing fins.

5. The structure of claim 4 wherein said projectile main body portion contains means laterally spacing said launch tubes from each other.

6. The structure of claim 5 wherein said laterally spacing means includes a multi-apertured support plate, a base support block, and a molded support body intermediate said support and said base support block, said launch tubes extending through said molded support body.

* * * * *